United States Patent [19]

Soto

[11] 4,373,565

[45] Feb. 15, 1983

[54] MALLET

[75] Inventor: Eduardo R. R. Soto, Rosario, Argentina

[73] Assignee: Tecnologia Argentina S.A., Rosario, Argentina

[21] Appl. No.: 244,782

[22] Filed: Mar. 17, 1981

[30] Foreign Application Priority Data

Apr. 16, 1980 [AR] Argentina ..... 280707

[51] Int. Cl.[3] ..... B25D 1/00

[52] U.S. Cl. ..... 145/36

[58] Field of Search ..... 145/36

[56] References Cited

U.S. PATENT DOCUMENTS 52,696 2/1866 Eddy ..... 145/36

3,844,321 10/1974 Cook ..... 145/36

FOREIGN PATENT DOCUMENTS 595706 7/1925 France ..... 145/36

592900 10/1947 United Kingdom ..... 145/36

996383 6/1965 United Kingdom ..... 145/36

*Primary Examiner*—Stephen G. Kunin

*Assistant Examiner*—J. T. Zatarga

*Attorney, Agent, or Firm*—Frishauf, Holtz, Goodman & Woodward

[57] ABSTRACT

To provide for effective force transfer upon striking of blows between plastic end portions covering a metal, typically steel, core without damage to the plastic striking end portions (201, 202), the plastic end portions (201, 202) form part of a single unitary plastic element (200) covering the metal core (100) which, generally, is of ellipsoid shape. The metal core has flat end portions (102, 103), with positioning protrusions (104, 105) extending into matching recesses formed in the striking portions (201, 202) of the plastic covering. The various surfaces of the metal core (102, 103; 106; 107, 108; 109) are joined by inclined surfaces which may be flat or curved and form part of the generally ellipsoid surfaces (110, 111, 112) whereby, upon striking of blows, fissures and breakage of the striking portions are avoided.

10 Claims, 7 Drawing Figures

A
B
A'
B'
X
X'
Y
Y'
L
M
M'
N
O
P
Q
R
S
T
101
102
103
104
105
106
108
109
110
112
113
114
200
201
202
203
204
205
206

MALLET

The present invention relates to hammers or mallets, and more particularly to mallets with an elastic head for use in sheet metal or automotive bodyshops.

BACKGROUND

Various types of mallets or hammers with elastic heads are used in workshops, particularly for sheet metal shaping and forming, for repairs, in automotive body and fender shops, and the like. Usually, the head of the mallet is made of rubber or similar elastomer material, or of plastic of more or less hardness. Blows can be struck against a work surface which may be painted, without marring the surface.

It is difficult to provide for good retention of an elastic or plastic head on a hammer body, particularly if the body of the hammer is to have a substantial weight so that the blows to be struck will provide sufficient impact force on the object or surface which is being hammered. Mallets, therefore, should have a core of heavy material, such as iron, steel, or the like, which is encased by rubber, plastic, or other similar substance, which is non-marring with respect to the surface to be struck. The surface to be struck should have the force of the hammer applied thereto evenly; this requires essentially even or uniform force transfer between the striking surface of the mallet and the interior components thereof. In the past, it was difficult to provide for good force transfer which insures adhesion of the outer elastic or non-marring rubber or plastic or similar portion without degradation or breakage thereof.

THE INVENTION

It is an object to provide a hammer or mallet which has a central head of an essentially non-yielding material, such as iron or steel, and an outer cover or coating of a strong flexible material such as a plastic polymer, rubberized elastomer, or the like, which is preferably non-marring when striking a surface, and in which forces being transferred upon striking a surface can be absorbed internally without causing stress concentrations leading to failure or rupture of the plastic or elastomer cover surrounding the iron core.

Briefly, the core element is made of a metallic body, steel or iron for example, which has an opening therein to which a hammer handle can be attached. The metal core has an upper face and lateral faces, as well as end faces. The end faces are vertical and have projecting therefrom rounded-off protrusions fitting into similarly shaped openings in the plastic cover ends. The planes of the other surfaces are relatively mutually positioned to be oblique, that is, at other than right angles, and of diverging configuration. The transverse central section of the metallic head is larger and wider than the ends, and the extreme vertical faces having an area which is between 50% to 70% of the area of a plane passing transversely through the center of the core. Consequently, the portion of the projected oblique or inclined surfaces of the core are between 50% to 30% of the total transverse area. Preferably, the plastic ends of the hammer are of essentially cylindrical cross section.

DRAWINGS

Figures 1, 2, 3, 4:
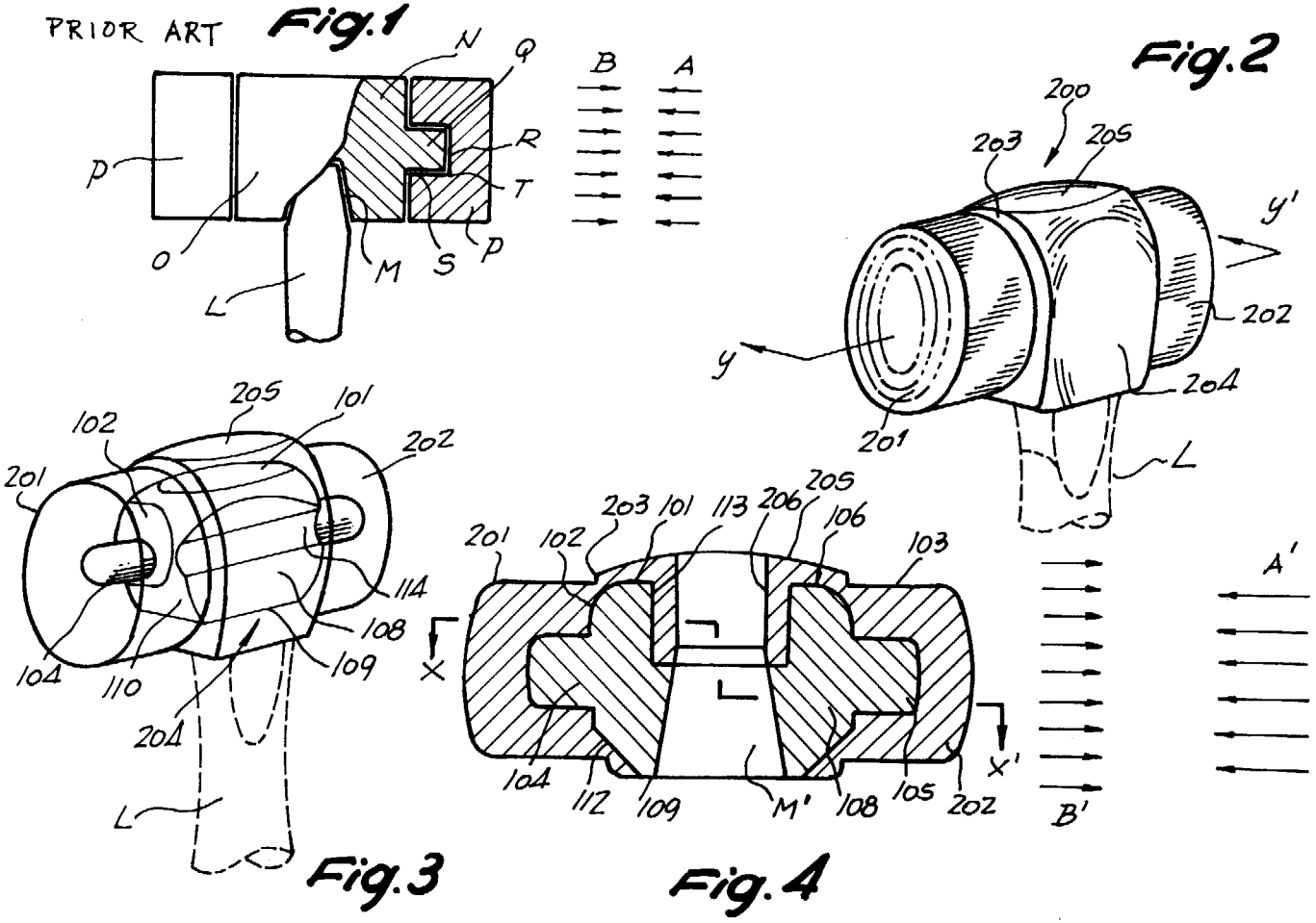
PRIOR ART Fig.1
FIG. 1 illustrates a hammer in accordance with the prior art in part-longitudinal sectional view.
FIG. 2 is a perspective view of a hammer incorporating the present invention.
FIG. 3 is a phantom perspective view of FIG. 2, showing the internal construction.
FIG. 4 is a vertical section along the plane y—y' of FIG. 2.

A typical type of mallet or hammer of the general configuration to which the present invention relates, and constructed according to the prior art, is shown in FIG. 1. This tool is a mallet, particularly suitable in automotive body-and-fender work. A handle L is fitted into a cavity M of a core N. The core N has end portions O which have terminal striker parts P of elastic material attached thereto. The striker ends P, typically of a plastic polymer material, are fitted to the core N in a suitable manner, for example by a press fit on a central projection Q, projecting from the core N into a recess or seat R formed in the plastic material; or by screw attachment passing in or through the plastic end parts P and into the core. Both attachment arrangements-screw attachment as well as press fit-can be used. The seat formed by the projection Q in the recess R of the end portion P results in damage to the end portion P. In use, the end portion P should transfer force from the center core N uniformly distributed throughout its end area or surface, as shown by the force arrows B. A reaction force must be absorbed by the end portion P, see the force arrows A. The forces illustrated by arrows A and B are equal and in opposite direction, under ideal conditions. Unfortunately, the ideal conditions do not pertain since the fitting surfaces terminate in corners S and T and force concentrations will occur at these corners. The force concentrations and non-uniformity of force distribution, consequent to the fit of the projection Q in the recess R results in loosening of the retentive force of the end portion P on the core N and, in limiting cases, in fracture of the end element or end portion P.

It has also already been proposed to construct the head N of two half-shells. This construction is not shown; in general, the internal arrangement is somewhat similar to that illustrated in FIG. 1. The half-shells are arranged to clamp projecting end portions from the elastic ends therebetween. The half-shells are held together by a stud, bolt or the like. This arrangement has the advantage that the elastic heads or end portions P can be easily changed if they should become damaged or break. This arrangement is suitable particularly when the lifetime of the end portion is not expected to be extensive, since rapid interchange is simple. The balance of the overall head of the mallet is frequently not as desired by the mechanic or user of the tool, and obtaining appropriate weight, as well as suitable weight distribution is difficult. The force distribution upon striking a blow with a hammer or mallet of this type is non-uniform and thus this tool has an average lifetime, before replacement of the ends, which is substantially less than that of other tools used in an automotive repair shop, which is undesirable for many applications.

The mallet head in accordance with the present invention has a specific shape and arrangement of the internal surfaces of the core to which matching surfaces of elastomer or other plastic ends are applied, the surface configuraions being especially selected to provide for uniformity of force transfer without concentration of forces at points which might cause damage to the head structure and, in a limiting case, loosening and breakage thereof.

Referring to FIG. 2: The handle L can be in accordance with any well known hammer or mallet handle, and can be similar to that used in connection with any mallet of the prior art. Since the particular type of handle does not form a part of the present invention, it is shown in broken lines in the drawings.

Figure 7:
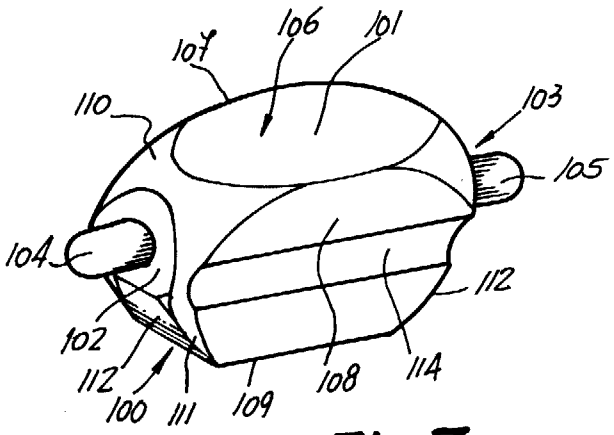
FIG. 7 is a perspective view of the core element also seen in FIG. 3, to an enlarged scale, and omitting the handle.

The head of the mallet, basically, has an internal or core element 100—see FIG. 7, and a second, monolithic outer cover body 200—see FIG. 2. The outer cover body 200 essentially entirely surrounds the inner core 100.

The central core or head 100 is made of heavy-weight metal, such as cast steel. It has a central portion 101 (FIG. 7) which terminates in two end or front planes 102, 103 extending vertically with respect to planes 101, that is, parallel to the direction of the handle L. The front and back planes 103 have protrusions 104, 105 (FIG. 7) extending therefrom. These protrusions increase the mass of the core and compensate for loss of equivalent mass in the region of the opening for the handle. They are positioned in line with the handle hole. The protrusions 104, 105 have rounded end portions in order to prevent force concentrations at corners from arising in use of the tool.

The core body 100 has an upper face 106 which is, basically, plane and horizontal—that is, extending at right angles to the end walls 102, 103—and which merges with lateral walls 107, 108 which extend essentially in vertical direction. The walls 107, 108 need not, however, be essentially vertical; they can taper somewhat inwardly, that is, towards a center plane of symmetry passing vertically through the core. The junction lines of plane 106 and the lateral planes 107, 108 are curved surfaces, as best seen in FIG. 7. Thus, the central core structure does not have a generally cylindrical or prismatic outline; rather, it is ellipsoid-shaped, with plane end and top, bottom and side surfaces. The curved surfaces 110, 111 and 112 are clearly seen in FIG. 7. The surfaces 112 may be straight, as seen in FIG. 7, or somewhat curved or rounded. The surfaces 110, 111, also, can be straight or rounded, the reference to the ellipsoid shape being intended to refer to the general appearance aspect, rather than to mathematically defined surfaces. Surfaces 112 may extend to the bottom surface 109.

Figure 5:
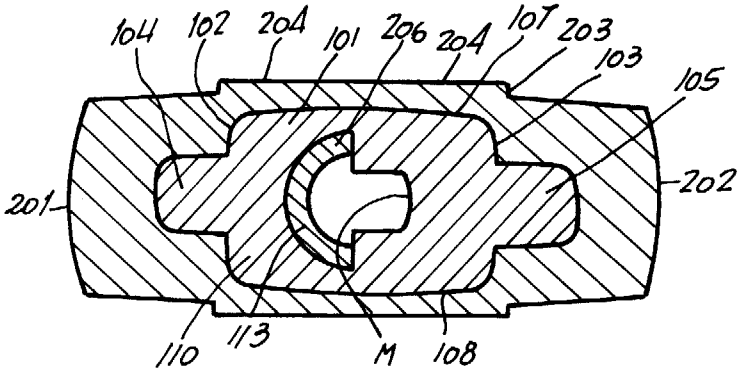
FIG. 5 is a horizontal, partly offset section along the section line x—x' of FIG. 4, in which the right-hand plane of the section is below that of the left-hand section plane—with respect to FIG. 4.

The polymeric body 200, which includes the actual striking surfaces with which the tool is to be used, is a single integral monolithic element. It covers and surrounds the core 100, and has two outer end portions 201, 202 (FIGS. 2, 4). Basically, the extreme end portions of the outer ends 201, 202 are essentially cylindrical at their outer circumference; they may, however, also be prismatic. The diameter of the outer portions progressively increase, so that they can be termed frusto-conical; from a narrower free end, the diameter of the outer end portion increases towards the center region of the mallet, and increases in the region at least approximately even with the planes 102, 103, or in advance thereof—see FIG. 5. The increase in diameter of the end portions 201, 202 can be gradual or, as shown in FIGS. 2, 5, may include a step 203.

The outer plastic body 200 has lateral planes 204 (FIG. 5) and an upper surface 205. The exact shape and configuration of planes 204 and surface 205 is not critical or important; it will be governed largely by the internal shape of the core, and can be arranged to have a suitable configuration which provides for a pleasing appearance. It is of fundamental importance, however, that the thickness of the walls defined by the surfaces 204 and 205 is aproximately constant, that is, that the covering thickness of plastic material internally of the walls or surfaces 204, 205 over the steel core 100 is generally and approximately uniform.

Uniformity of thickness of the covering walls has this effect in force transfer relationships: The ends 201, 202 (see FIGS. 4 and 5) have a generally acceptable and suitable diameter, for example about 5.5 cm—roughly slightly larger than 2 inches. The corresponding portion 102 of the body 100 is substantially smaller, for example, has a diameter of about 2.5 cm—about 1 inch. The inclined planes 110, 111, 112, which are contiguous to the vertical wall 102, provide for gradual decrease of the wall thickness of the adjacent covering walls of the elastomer body 100 without any transition formed by sharp edges which might result in force concentration. At the same time, one can readily observe—see FIGS. 4 and 5—that the transverse area of the body 100 is at all times at least 30% to 50% larger than the frontal area of the surface 201 or 202 which transfers the forces of the blows which arise in use of the mallet. FIG. 4 includes the force diagram in which the internal forces B′ can be seen to be substantially smaller than the reaction forces A′ which represent the action of the tool on the object being struck.

The cross-sectional area of the body 200 increases from the terminal end of the surfaces 201, 202 towards the center until it becomes between 30% to 50% larger than the frontal area of the respective surface 201, 202. The frontal area 201, 202 of course is that area which is available for hammering, that is, where the blow is being struck. The internal resisting force of the plastic material, which is resilient and elastic, is notably less than the force which it is capable of absorbing in compression when the core 100 acts on the surface to be struck through the elastic covering. The presence of the plurality of inclined planes which start from the end faces 102, 103 of the core 100 distributes the forces within the plastic end portions uniformly and without force concentrations which might result in breakage or fissures of or in the material.

The outer cover, being monolithic, totally encloses the core 100. Thus, a portion of the reaction force can be absorbed by the remainder of the plastic part 200; some of the plastic, at the side remote from the object to be struck will be placed in tension. This further reduces the forces within the monolithic body 200 to a value which is smaller than that which can be theoretically calculated. It has been found that an average force distribution within the plastic material which is 40% smaller than that at the end which strikes the object will have to be absorbed by the material 200 in the regions which are not in direct line with the blow.

The overall force distribution within the plastic body 200 thus will be comparatively uniform and much more so than in prior art structures. The balance of the head is excellent, since the weight distribution will be such that the center of gravity of the overall structure is essentially similar to that of a common hammer without a plastic or other non-marring end portion, a result not obtained with hammers illustrated, for example, in FIG. 1. The protrusions 104, 105, which can be so positioned that they, essentially, balance the loss of material within the core due to the presence of the handle hole, provide for excellent balance.

Figure 6:
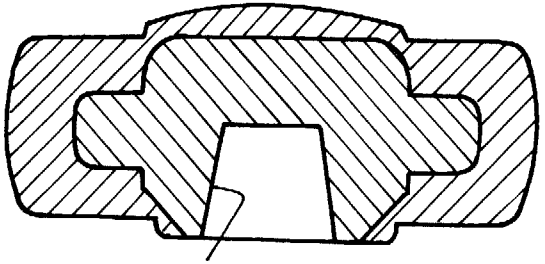
FIG. 6 is a view similar to FIG. 4 and illustrating another embodiment.

The handle can be attached into the combination of the core 100 in a conventional manner. FIG. 6 illustrates an arrangement in which an orifice or a cavity M is formed, which is free from plastic material of the body 200. The handle can be wedged therein, or fitted, using bonding adhesives and, if desired, an expansion wedge which can be passed through the closed end of the orifice M (not shown) in conventional manner can be used.

Another alternative, and which is a preferred form, is attaching the handle as shown in FIGS. 4 and 5. This arrangement provides for a sleeve or lining 206 extending into the through-opening M' and forming part of the outer plastic covering body 200. The sleeve or lining (206) is fitted into an enlargement 113 formed in the body 100, and made of the same material and integral with the elastomer body 200. On the one hand, the internally fitting sleeve or lining 206 provides for the effect of a bushing or a soft pillow seat, while, on the other, providing for continuity of absorption of forces to the elastomer body 200, by securing the body 200 within the head 200 and directly to the handle L.

The lower face 109 of the body 100 need not and usually is not covered by the material of the body 200. Body 200, thus, will not penetrate inside the cavity M or M', respectively, for the handle L.

The body 200 is preferably bonded or adhered to the body 100 by suitable adhesives or bonding materials, compatible with the respective materials of the body 200 and 100. In order to improve adhesion, and close fitting of the respectively mutually engaging surfaces, the lateral faces of the core body 100 and the outer cover 200 can be formed with matching, interfitting grooves, channels, or orifices. As an illustration, a groove 114 (FIG. 7) is provided in the lateral face 108 of the core, into which a matching ridge formed on the body 200 (not shown) fits—see, also, the phantom view of FIG. 3.

Various changes and modifications may be made, and the specific shapes which the body 100 or the body 200 may have can be varied, as required. The dimensions given are approximate and not critical, and can be changed to suit various requirements of use. Generally, a cylindrical outer surface 201, 202 is preferred, although the outer surface may, also, be polygonal. The materials used are conventional and can be those customarily used in connection with prior art mallets for similar use.

I claim:

1. Malet or hammer having a metal core (100) having two end surfaces (102, 103), and a bottom surface (109);

an opening (M, M') formed in the core and extending through the bottom surface to receive a handle (L);

and striking portions (201, 202) of elastomer material secured to the metal core, wherein, in accordance with the invention, the metal core (100) has generally ellipsoid shape;

the end surfaces (102, 103) are parallel planes having a surface area which is between 50% to 70% of the area of the core at a central section thereof;

an essentially plane top surface (106) extending transversely to the end surfaces;

essentially plane side surfaces (107, 108) extending laterally of a plane of symmetry through the handle opening (M, M');

a first inclined surfaces (110) connecting said end surfaces (102, 103) with said plane top surface (106);

second inclined surfaces (112) connecting the end surfaces (102, 103) and the bottom surface (109);

third inclined surfaces (111) connecting said end surfaces (102, 103) and said side surfaces (107, 108);

a projection (104, 105) extending at right angles from each of the plane end surfaces (102, 103), said projections having rounded end portions;

and wherein a unitary plastic cover element (200) is provided having said striking portions (201, 202) formed thereon at terminal ends of said element, said plastic cover element being formed with internal surfaces which match and fit said end surfaces (102, 103), said top surface (106), said side surfaces (107, 108) and said first, second and third inclined surfaces (110, 111, 112), the striking portions (201, 203) being formed with recesses to accept said projections (104, 105); and wherein the area of the cover element, in transverse section, increases by at least 30% from the end surfaces of the striking portions to the central section, and the wall portions of the cover element adjacent said top surface and said side surfaces are of essentially uniform thickness.

2. Mallet according to claim 1, wherein said opening (M) in the bottom surface of the core and to receive the handle is a blind opening;

and said unitary plastic cover element (200) extends over said core to a region short of the edge of said opening.

3. Mallet according to claim 1, wherein said opening (M') formed in the metal core is a through-bore;

and said unitary plastic cover element (200) is formed with a depending unitary sleeve (206) extending into said through-bore to provide a cushion and connecting portion for the handle (L), the handle extending through said opening and into said sleeve (206).

4. Mallet according to claim 1, wherein at least one surface including said top surface (106) and said side surfaces (107, 108) is formed with a surface deformation (114), and the plastic cover element is formed with a matching surface deformation to provide for interlocking engagement of the respective deformations of the metal core (100) and of the plastic cover element (200).

5. Mallet according to claim 4, wherein said surface deformation comprises at least one longitudinal groove (114) formed in each of the side surfaces (107, 108), and the matching deformation in the plastic cover element comprises a ridge fitting into said groove.

6. Mallet according to claim 1, wherein the unitary cover element (200) covers only part of the bottom surface (109) of said metal core.

7. Mallet according to claim 1, wherein some of the surfaces (110, 111) of the core are curved, and the junction lines between the inclined surfaces and the adjacent plane surfaces are curved.

8. Mallet according to claim 1, wherein some of the inclined surfaces (112) are flat.

9. Mallet according to claim 1, wherein the end surface of the striking portions (201, 202) is essentially circular and of greater diameter than the diameter of the end surfaces (102, 103) of the metal core.

10. Mallet according to claim 1, wherein the increase in area of the transverse section of said unitary plastic cover element is in step form defining a shoulder (203) at a step, and said step is positioned in advance of a plane passing through said end surfaces (102, 103) on the metal core.

* * * * *